United States Patent [19]

Lefevre et al.

[11] Patent Number: 4,759,724

[45] Date of Patent: Jul. 26, 1988

[54] HOUSING FOR AN ELECTRICAL DEVICE

[75] Inventors: Philippe Lefevre; Gilbert Echasseriau; Patrice Oliveau, all of Toulouse, France

[73] Assignee: Bendix Electronics S.A., Toulouse, France

[21] Appl. No.: 20,152

[22] Filed: Feb. 25, 1987

Related U.S. Application Data

[63] Continuation of Ser. No. 797,058, Nov. 12, 1985, abandoned.

[30] Foreign Application Priority Data

Nov. 27, 1984 [FR] France ..... 84 18022

[51] Int. Cl.[4] ..... H01R 4/24

[52] U.S. Cl. ..... 439/425

[58] Field of Search ..... 439/425, 426

[56] References Cited

U.S. PATENT DOCUMENTS

| | | | |
|---|---|---|---|
| 1,666,729 | 4/1928 | Biek et al. | 439/425 |
| 1,909,412 | 5/1933 | Ludwig | 339/99 R |
| 2,735,078 | 2/1956 | Greenbaum | 339/99 R |
| 2,810,115 | 10/1957 | Abbott | 339/97 P |
| 3,107,134 | 10/1963 | Kerrigan | 439/426 |
| 3,571,779 | 3/1971 | Collier | 439/426 |
| 3,663,924 | 5/1972 | Gerlat | 339/99 R |
| 3,935,637 | 2/1976 | Bunnell | 339/97 P |
| 4,379,605 | 4/1983 | Hoffman | 339/97 P |

*Primary Examiner*—Joseph H. McGlynn

*Attorney, Agent, or Firm*—Russel C. Wells; Markell Seitzman

[57] ABSTRACT

Housing (14) for an electrical device (10), comprising a first cavity (16) inside which the functional part of (12) of the system is arranged, and a second cavity (18) for performing an electrical connection, which is separated from the first cavity by a leak-tight wall (20) through which a metal lug (22) for making an electrical connection passes, a first end (36) of the said lug, which is situated inside the first cavity (16), ensuring an electrical connection wth the functional part of the system and the second end (26) of the said lug, which is situated inside the second connection cavity (18), being provided with means (28) for ensuring electrical connection (10) with an electrical wire (30).

1 Claim, 1 Drawing Sheet

HOUSING FOR AN ELECTRICAL DEVICE

This application is a continuation of application Ser. No. 797,058, filed Nov. 12, 1985, now abandoned.

The present invention relates to a housing for an electrical or electronic device and aims more particularly to overcome various problems posed by electrical connection of the device.

The known housings for electrical devices pose various problems relating to electrical connection of the device and, in particular, with regard to operation and assembly tests.

Generally speaking, the functional tests for checking the device can only be carried out after connection, or link-up, of the electrical wires, which leads to problems regarding maintenance.

In existing technology it will be noted that the electrical wires are fixed to the cover or to the actual housing. In both cases, connection is performed in the same cavity as that containing the functional part of the device, which means that this cavity must be closed beforehand in order to carry out the electrical tests ; closure is effected most frequently by means of heat welding or gluing.

Connection of the electrical wires when the electrical device is assembled poses two major problems :

(a) as regards the assembly stages subsequent to connection of the wires : handling of the devices is not easy and poses major difficulties in particular on automated assembly lines ;

(b) as regards the stock handling of the electrical devices and the parts : in fact, non-standardization means that the wire lengths vary greatly and the stock handling of the different sub-assemblies associated to the wires is consequently very complex.

In order to overcome the above-mentioned drawbacks, the present invention proposes a housing for an electrical or electronic device, comprising a first cavity sheltering the functional part of the device, and a second cavity for sheltering an electrical connection, said second cavity being sealingly separated from said first cavity by a wall, an electrical connector having a metal lug extending through said wall, a first end of the said lug situated inside said first cavity, ensuring electrical connection with the functional part of the device and the second end of said lug situated inside said second cavity being provided with means for ensuring electrical connection with an electrical wire.

A description now follows of the invention with reference to the attached drawing in which :

FIG. 1 illustrates an electrical device consisting, in the embodiment shown, of an electrical potentiometer, the functional part 12 of which is arranged inside a housing 14.

Figure 1:
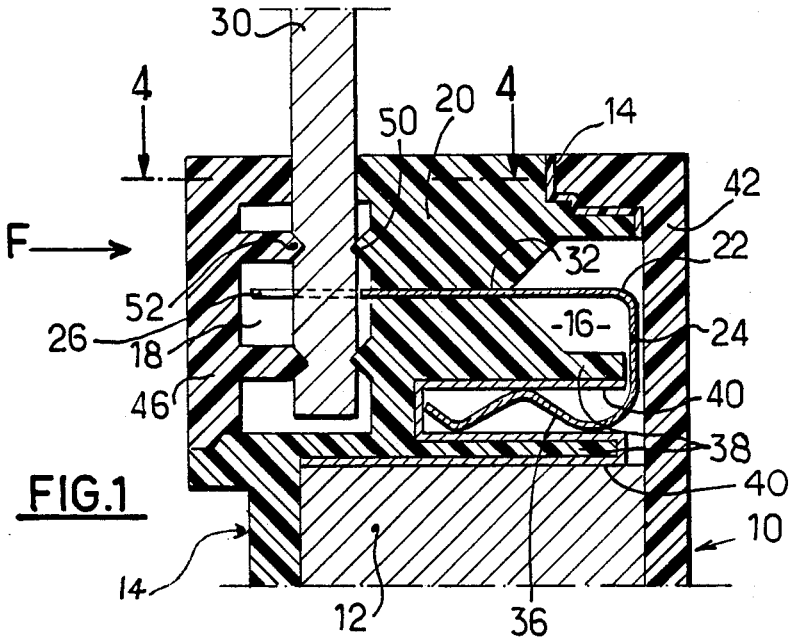
FIG. 1 is a cross-section illustrating schematically an embodiment of the invention applied to an electrical potentiometer.

The housing 14 comprises a first cavity 16 inside which the functional part 12 is arranged and a second cavity 18 for sheltering an electrical connection.

The two cavities are separated by a wall 20 which ensures that the cavities 16 and 18 are independent and sealed.

The part of housing 14 forming the wall 20 has, sealingly passing through out it, a metal lug 22 for making an electrical connector.

A first end 24 of the metal lug 22 is situated inside the first cavity 16, inside which it ensures that an electrical connection is made with the functional part 12 of the electrical system in a manner which wil be described below.

The second end 26 of the metal lug 22, situated inside the second cavity 18 for sheltering an electrical connection, is provided with means 28 for ensuring electrical connection of the metal lug 22 with an electrical wire 30.

The metal lug 22 is inserted from the right-hand side, looking at FIG. 1, into the passage 32 formed in the partition 20 where it is held in the mounted position by means of teeth 34.

Electrical connection of the first end 24 of the metal lug 22 is obtained by means of an elastic portion 36 in the latter which is inserted, by means of elastic deformation, between the two fixed flanges 38 of the housing 14. Electrical connection is ensured by means of contact with a metallic strip 40 electrically connected to the functional part 12 of the rotary potentiometer 10.

The first cavity 16 is closed, after insertion of the metal lug 22, by means of a first cover-piece 42.

The leak-tightness and electrical insulation of the cavity 16 is obtained by applying a protective resin 48 inside the cavity 16.

Figure 2:
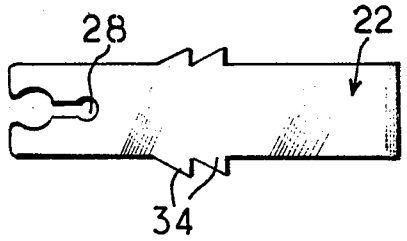
FIG. 2 is a plan view of the metal lug shown in FIG. 1.
Figure 3:
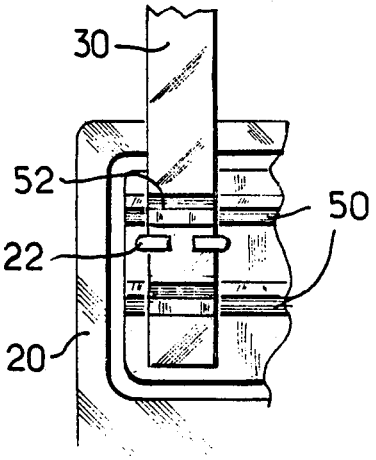
FIG. 3 is a partial side view in the direction of the arrow F of FIG. 1, the cover-piece of the second cavity having been removed.
Figure 4:
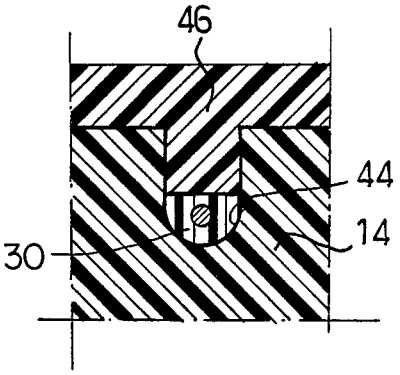
FIG. 4 is a partial cross-section along the line 4—4 of the FIG. 1.

The electrical connection between the second end 26 of the metal lug 22 and the wire 30 is achieved by the means 28 which enble the connection to be performed in displacing the insulating material of the wire. This operation is performed by introducing laterally the wire 30 and its insulating sheath into the recess 44 provided for this purpose in the housing 14 and into the central slot 28 provided in the lug 22. As shown on FIG. 2, the slot 28 is provided with an enlarged portion located at its open-end so as to receive the insulating sheath of the wire 30.

Closure of the second cavity 18 is obtained, as for the first cavity 16, by means of a second cover-piece 46, and leak-tightness is completed by adding resin 48 which surrounds the sheath of the wire 30 in the region of the recess 44.

In order to ensure that the wire 30 is mechanically held, the wall 20 and the second cover-piece 46 are provided with projections 50 and 52, respectively, which are arranged opposite each other and which grip the sheath of the wire 30 when the second cover-piece 46 is in its mounted position.

It is understood that the invention is not limited to the use of a single lug but also covers in other embodiment the use of several lugs permitting the electrical connections of a plurality of electrical wires to electrical or electronic devices. In that case the lugs are connected to separate contact strips.

The design of the housing described above in particular enables electrical checks to be performed in the second cavity by effecting a connection on the lug 22, while the final check for electrical continuity between the lug 22 and the wire is performed subsequently.

We claim:

1. Housing for an electrical device adapted to be connected to an electric wire, said housing comprising:

a first cavity enclosing the functional part of the device;

an electrical contact strip in said first cavity connected to the electrical device;

a second cavity for enclosing an electrical connection, said second cavity being separated from said first cavity by a wall;

at least one electrical connector having at least one metal lug extending through said wall, the first end of said lug situated inside said first cavity having an elastic portion resting against said electrical contact strip, and the second end of said lug situated inside said second cavity being provided with means for ensuring electrical connection with the electrical wire;

resin means within said first cavity for insulating and making said first cavity leak-tight;

a first cover enclosing said first cavity and said first end of said lug;

a second cover enclosing said second cavity for securing the insulating sheath of the electrical wire to hold the wire on the second end of the metal lug, said second cover being removable for providing access to said second end of said lug without opening said first cavity.

* * * * *